US006234186B1

(12) United States Patent
Tsai

(10) Patent No.: US 6,234,186 B1
(45) Date of Patent: May 22, 2001

(54) CANOPY FRAME FOR UMBRELLA OF VARIOUS SHAPES

(75) Inventor: Chin-Fu Tsai, Changhua Hsien (TW)

(73) Assignee: Yuan Jinn Fwu Co., Ltd., Changhua Hsien (TW)

( * ) Notice: Subject to any disclaimer, the term of this patent is extended or adjusted under 35 U.S.C. 154(b) by 0 days.

(21) Appl. No.: 09/249,772

(22) Filed: Feb. 16, 1999

(51) Int. Cl.[7] ..... A45B 19/00; A45B 11/00

(52) U.S. Cl. ..... 135/25.33; 135/28; 135/29; 135/31

(58) Field of Search ..... 135/25.33, 28, 135/29, 31, 39, 98

(56) References Cited

U.S. PATENT DOCUMENTS

| | | | | |
|---|---|---|---|---|
| 334,588 | * | 1/1886 | Jones . | |
| 492,955 | * | 3/1893 | Brown . | |
| 527,823 | * | 10/1894 | Wirt . | |
| 661,169 | * | 11/1900 | Ekelund . | |
| 748,359 | * | 12/1903 | Fogle . | |
| 807,572 | * | 12/1905 | Muzzio . | |
| 829,858 | * | 8/1906 | Eaton . | |
| 831,381 | * | 9/1906 | Sawaya . | |
| 952,630 | * | 3/1910 | Philp . | |
| 959,962 | * | 5/1910 | Peterson . | |
| 995,266 | * | 6/1911 | Lundberg . | |
| 1,031,868 | * | 1/1912 | Peterson . | |
| 1,045,976 | * | 12/1912 | Hildreth . | |
| 1,049,360 | * | 1/1913 | Hoffman . | |
| 1,060,555 | * | 4/1913 | Peterson . | |
| 1,117,365 | * | 11/1914 | Frisk et al. . | |
| 1,513,655 | * | 10/1924 | Turner . | |
| 3,217,724 | * | 11/1965 | Szivatz . | |
| 3,746,024 | * | 7/1973 | Kida . | |
| 3,779,260 | * | 12/1973 | Garay | 135/20 |
| 3,837,352 | * | 9/1974 | Weber . | |
| 4,007,753 | * | 2/1977 | DeMarco . | |
| 4,641,675 | * | 2/1987 | Wu . | |
| 5,307,827 | * | 5/1994 | Haddad et al. . | |
| 5,355,903 | * | 10/1994 | Haddad et al. . | |
| 5,370,144 | * | 12/1994 | Yang . | |
| 5,752,534 | * | 5/1998 | Becher . | |
| 5,909,746 | * | 6/1999 | Doster et al. . | |

* cited by examiner

*Primary Examiner*—Robert Canfield
(74) *Attorney, Agent, or Firm*—Browdy & Neimark

(57) ABSTRACT

A canopy frame for umbrellas has a structure adapted for various shapes, making the appearance of umbrellas dexterous and interesting. The frame has a main shaft, an upper sliding notch, a lower sliding notch, multiple positioning ribs, multiple upper spreaders, upright ribs, upper angle-forming clamps, auxiliary stretchers, lower spreaders and multiple clamping pieces. Two positioning holes are on the main shaft for the fixing of the upper and lower sliding notch and at the top end of the main shaft is disposed the fixed notch. The upper and lower sliding notch mounted consecutively on the main shaft under the fixed notch. One end of each positioning rib is connected to the fixed notch and the other end is associated with an upper angle-forming clamp. One end of each upper spreader is fixed to the upper sliding notch and the other end is engaged with the middle hinge point of the upper angle-forming clamp. One end hinge point of each angle-forming clamp is coupled to one end of each upright rib to which is mounted a clamping piece at the other end. The upright rib has a hinge projection at one end to which one end of each auxiliary rib is connected and the other end is fixed to an end hinge point of a lower angle-forming clamp, and each lower angle-forming clamp is associated with a folding rib. Thereby when a canopy is mounted to the frame, umbrellas of various shapes can be obtained.

1 Claim, 7 Drawing Sheets

CANOPY FRAME FOR UMBRELLA OF VARIOUS SHAPES

BACKGROUND OF THE INVENTION

The present invention relates to an improved canopy frame for use on umbrellas which have their canopies structured in various shapes, making the external appearance of umbrellas dexterous, attractive and interesting. The frame is comprised of a main shaft, an upper sliding notch, a lower sliding notch, multiple positioning ribs, multiple upper spreaders, multiple upright ribs, multiple upper angle-forming clamps, multiple auxiliary stretchers, multiple lower spreaders and multiple clamping pieces. There are two positioning holes on the main shaft for the fixing of the upper and lower sliding notch and at the top end of the main shaft is disposed the fixed notch. The upper and lower sliding notch mounted consecutively on the main shaft under the fixed notch. One end of each positioning rib is connected to the fixed notch and the other end is associated with an end hinge point of an upper angle-forming clamp. One end of each upper spreader is fixed to the upper sliding notch and the other end is engaged with the middle hinge point of an upper angle-forming clamp. One end hinge point of each angle-forming clamp is coupled to one end of each upright rib to which is mounted a clamping piece at the other end. The upright rib has a hinge projection at one end to which one end of each auxiliary rib is connected and the other end is fixed to an end hinge point of a lower angle-forming clamp, and each lower angle-forming clamp is associated with a folding rib. Thereby when a canopy is mounted to the frame, umbrellas of various shapes can be obtained.

The improved canopy frame is easily converted into different kinds of shapes so as to make umbrellas produced in dexterous forms for commercial advertisements or just to be used as common umbrellas, which can better protect people from getting wet by rain.

In general, common umbrellas are all made to have a simple canopy frame including a main shaft on which a runner is slidably moved to get a frame to stretch open, and a canopy attached to the frame is extended in an arch shape without any variations for decades. Such a structure is not ideal enough to permit commercial advertisements to be printed on the canopy in one aspect, and such an umbrella is not good enough to protect a person under the umbrella from getting wet by rain cast in slant directions.

SUMMARY OF THE INVENTION

Therefore, the primary object of the present invention is to provide an improved canopy frame for umbrellas of various shapes. It has a main shaft having a fixed notch, an upper sliding notch, a lower sliding notch disposed thereon, and a plurality of ribs, spreaders, stretchers of various length are associated with the respective notches and a plurality of upper angle-forming clamps and lower angle-forming clamps secured to the respective ribs, spreaders and stretchers whereby various frame structures can be obtained for mounting of corresponding canopies, making umbrellas of various shapes possible.

Another object of the present invention is to provide an improved canopy frame which is provided with upright ribs and folding ribs so as to transparent drape panels to be downwardly extended to stop rain cast in slant directions from coming into the covered area of an umbrella without blocking the sight of a user.

BRIEF DESCRIPTION OF THE INVENTION

DETAILED DESCRIPTION OF THE PREFERRED EMBODIMENTS

Figure 1:
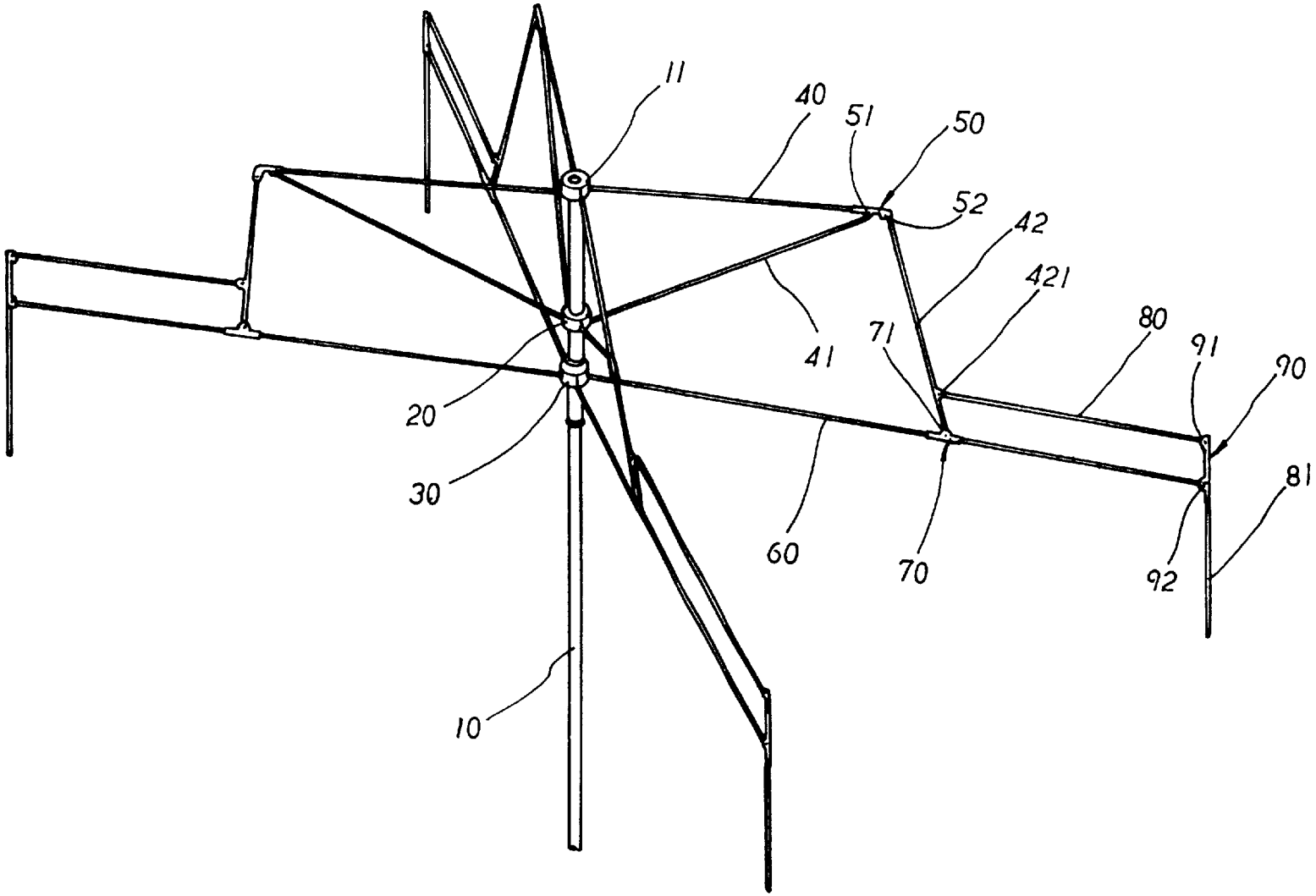
FIG. 1 is a diagram showing a fully extended canopy frame of the present invention.

There are several embodiments of the canopy frame of the present invention disclosed in company with the drawings. Referring first to FIG. 1, a canopy frame in the shape of a vehicle is illustrated in a perspective manner. The frame comprises a main shaft 10, an upper sliding notch 20, a lower sliding notch 30, four positioning ribs 40, four upper spreaders 41, four upright ribs 42, four upper angle-forming clamps 50, four lower spreaders 60, four clamping pieces 70, four auxiliary stretchers 80, four folding ribs 81 and four lower angle-forming clamps 90.

At the upper portion of the main shaft 10 is provided with a pair of positioning holes (not shown) for the mounting of the upper sliding notch 20 and the lower sliding notch 30, and a fixed notch 11 is secured to the top end of the main shaft 10.

The upper sliding notch 20 and the lower sliding notch 30 are mounted below the fixed notch 11 consecutively. The four positioning ribs 40 are connected to the fixed notch 11 at one end thereof in a cross manner. At the other end of the each positioning rib 40 is disposed an upper angle-forming clamp 50.

One end of each upper spreader 41 is fixed to the upper sliding notch 20 and the other end thereof is further secured to a middle hinge point 51 on each upper angle forming clamp 50. One end of the lower spreader 60 is fixed to the lower sliding notch 30 and the other end is fixed to a middle hinge point 92 of the lower angle-forming clamp 90. Near the middle of the lower spreader 60 is disposed a clamping piece 70. An upright rib 42 is connected at its ends to the end hinge point 52 of the upper angle-forming clamp 50 and to the middle hinge point 71 of the clamping piece 70. A hinge projection 421 is disposed adjacent the lower end of the upright rib 42. Each auxiliary stretcher 80 has one end coupled to the hinge projection 421 of the upright rib 42 and the other end connected to the end hinge point 91 of the lower angle-forming clamp 90 which is engaged with a folding rib downwardly.

Figure 2:
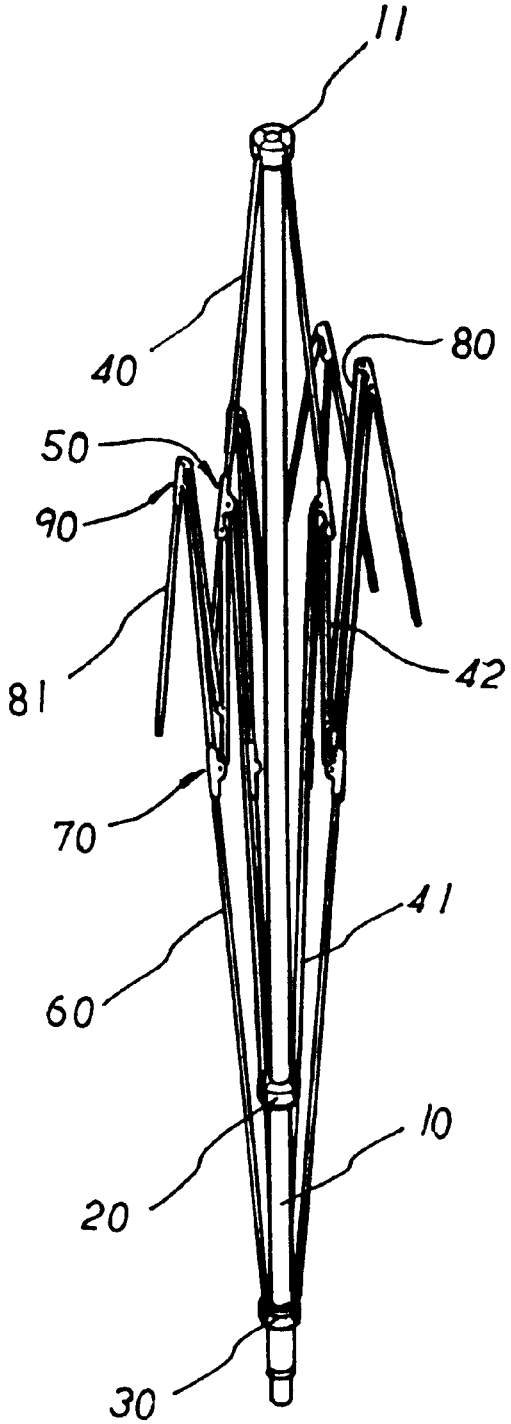
FIG. 2 is a diagram showing the canopy frame in a fully collapsed state.

In a folding state, as shown in FIG. 2, the upper sliding notch 20 and the lower sliding notch 30 are pulled downwardly, all the frame components are withdrawn to collapse in abutment against the main shaft 10 to complete the folding process.

Figure 3:
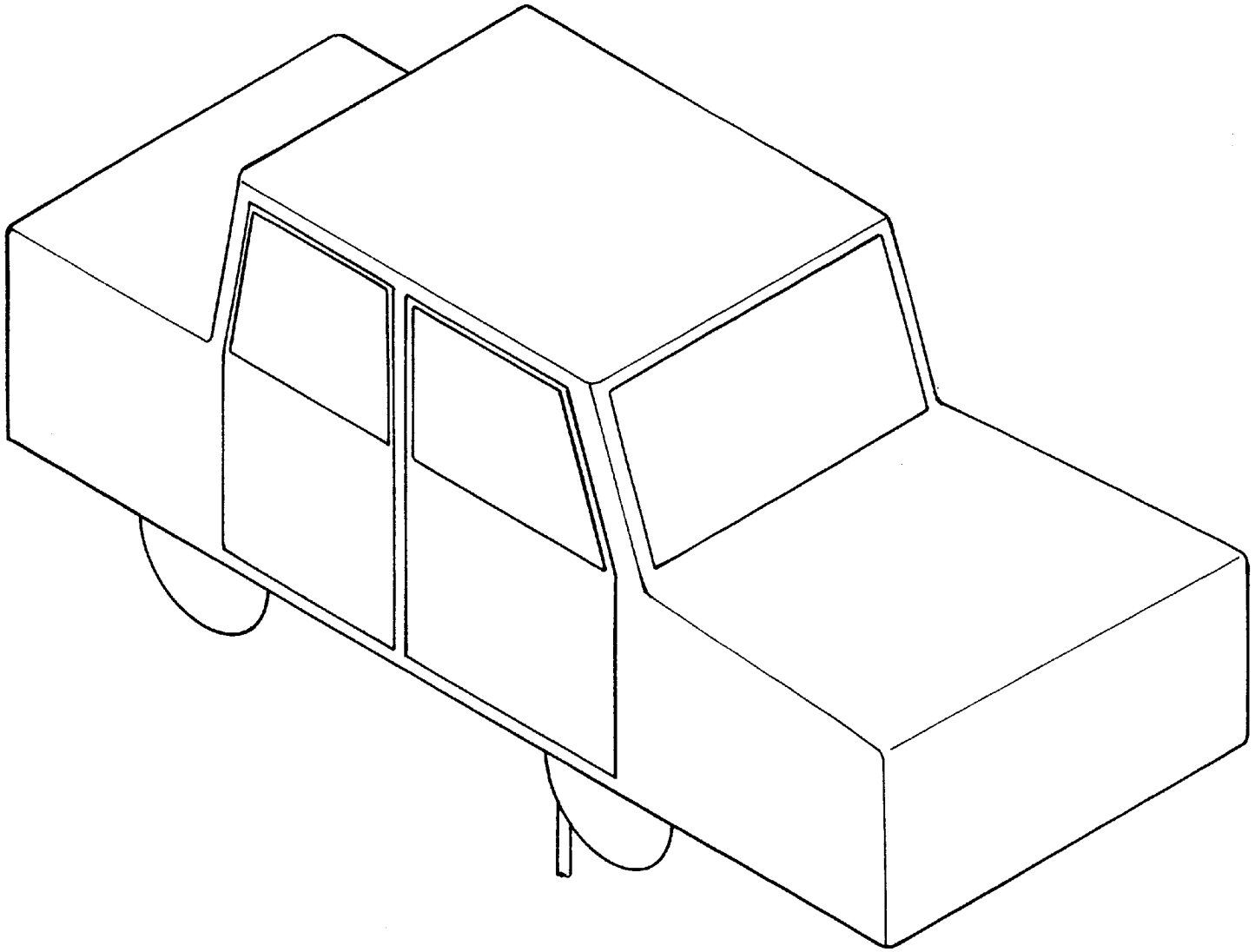
FIG. 3 is a diagram showing the canopy frame applied to a car-shaped umbrella.

Thereby, if a vehicle shaped canopy is mounted onto the frame and the frame is extended, a vehicle shaped umbrella is obtained, as shown in FIG. 3.

Figure 4:
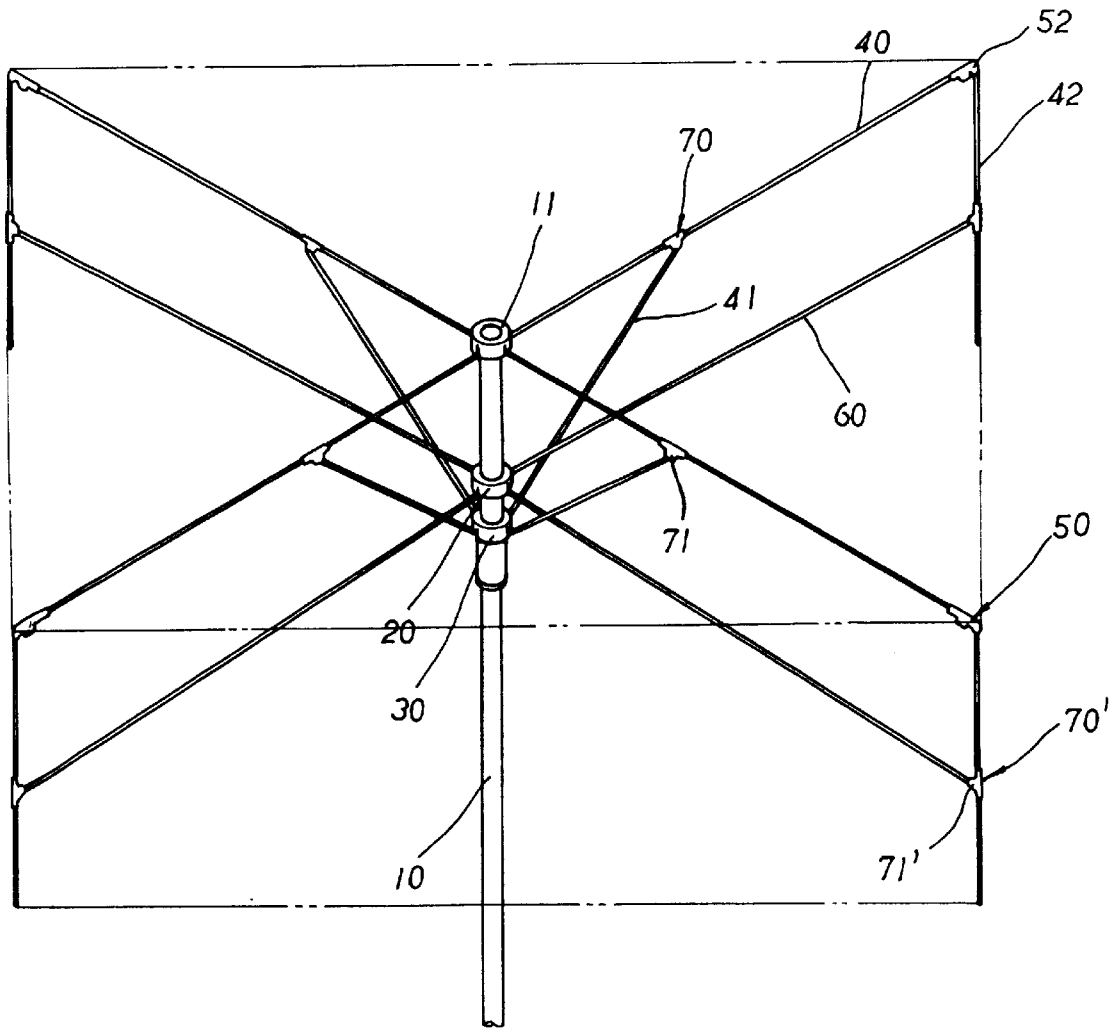
FIG. 4 is a diagram showing a rectangular frame structure of the second embodiment of the present invention.

Referring to FIG. 4, a second embodiment of a square shaped canopy frame is illustrated It is made up of a main shaft 10, an upper sliding notch 20, a lower sliding notch 30, four positioning ribs 40, four upper spreaders 41, four upper angle-forming clamps 50, four lower spreaders 60 and eight clamping pieces 70, 70'. The main shaft 10 is provided with a pair of positioning holes for the securing of the upper sliding notch 20 and the lower sliding notch 30 at the upper portion thereof A fixed notch 11 is secured to the top end of the main shaft 10 and the upper sliding notch 20 and the lower sliding notch 30 are disposed consecutively under the fixed notch 11. One end of each positioning rib 40 is secured to the fixed notch 11 and the other end is fixed to the upper angle-forming clamp 50. Near the middle but slightly shifted toward the fixed notch 11 is disposed a clamping piece 70. One end of the upper spreader 41 is connected to the lower sliding notch 30 and the other end thereof is coupled to the a middle hinge point 71 of the clamping piece 70. To the end hinge point 52 of the upper angle-forming clamp 50 is connected one upright rib 42 which extends downwardly a distance and has a clamping piece 70' disposed at the middle thereof. To the middle hinge point 71' of the clamping piece 70' is connected one end of the lower spreader 60. The other end of the positioning rib 40 is coupled to the upper sliding notch 20. The length of the positioning rib 40 is identical to that of the lower spreader 60. When extended, each positioning rib 40 and each lower spreader 60 of the canopy frame are horizontally placed in a parallel position and the upright ribs 42 are vertically located. When a canopy is attached to the frame, a rectangle shaped umbrella is obtained.

Figure 5:
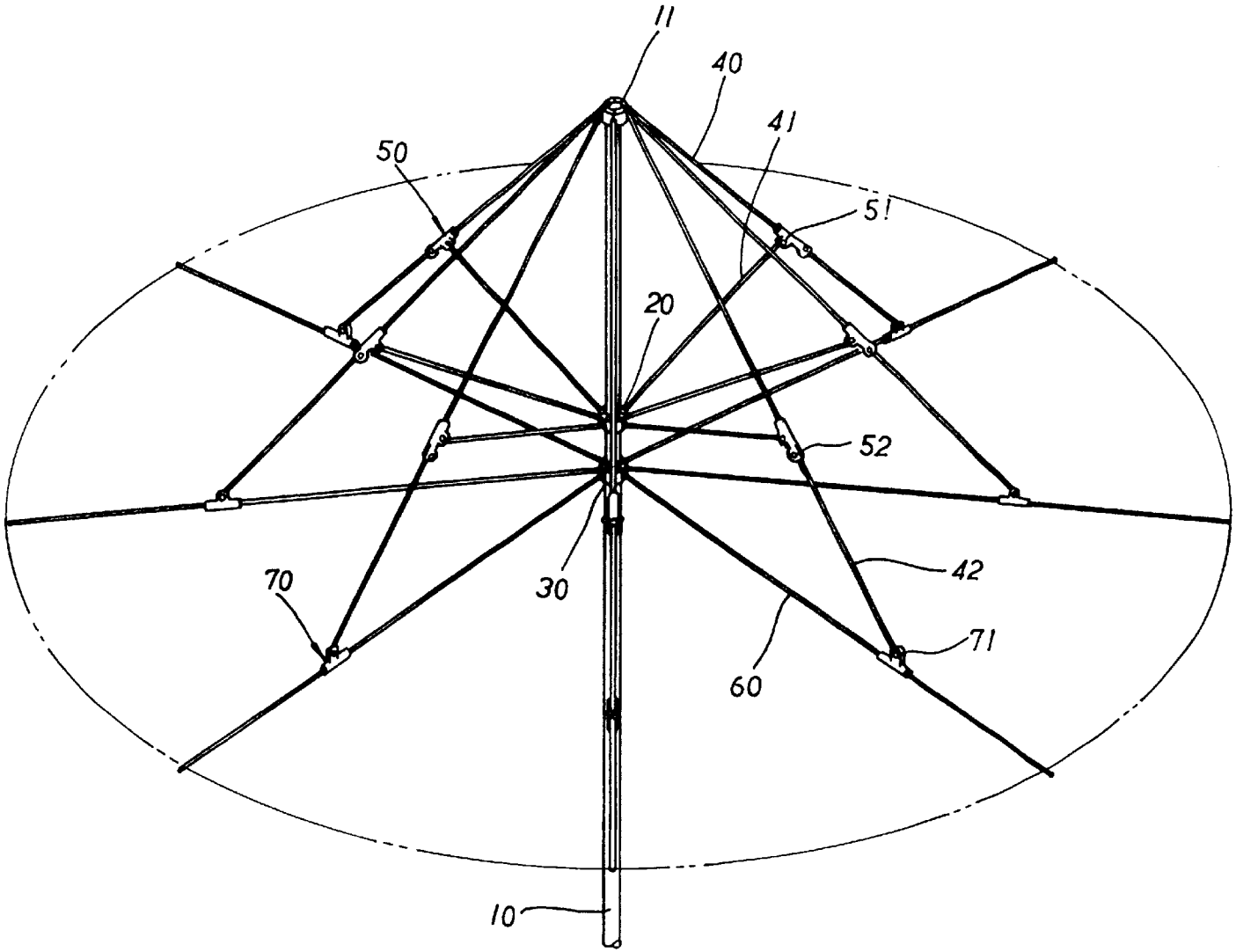
FIG. 5 is a diagram showing a canopy frame of the third embodiment in the shape of a traditional Chinese farmer's wide-brimmed rain hat.

Referring to FIG. 5, a wide-brimmed rain hat for Chinese farmers is illustrated. The framed is comprised of a main shaft 10, an upper sliding notch 20, a lower sliding notch 30, eight positioning ribs 40, eight upper spreaders 41, eight upright ribs 42, eight upper angle-forming clamps 50, eight lower spreader 60 and eight clamping pieces 70. There are two positioning holes (not shown ) on the main shaft at proper positions for the securing of the upper sliding notch 20 and the lower sliding notch 30. A the top of the main shaft 10 is disposed a fixed notch 11 and the upper sliding notch 20 and the lower sliding notch 30 are placed consecutively, under the fixed notch 11, on the main shaft 10. One end of each positioning rib 40 is connected to the fixed notch 11 and the other end is coupled to the end hinge point 52 of an upper angle-forming clamp 50. One end of the upper spreader 41 is coupled to the middle hinge point 51 of an upper angle-forming clamp 50 and the other end is connected to the upper sliding notch 20. The lower spreader 60 is engaged with the lower sliding notch 30 at one end and a clamping piece 70 is secured to a point at a distance from the center of the lower spreader 60. Each upright rib 42 is pivotally fixed to an end hinge point 52 of an upper angle-forming clamp 50 and the middle hinge point 71 of a clamping piece 70. A canopy fixed to the frame is then shaped like a wide brimmed rain hat of Chinese farmers.

Figure 6:
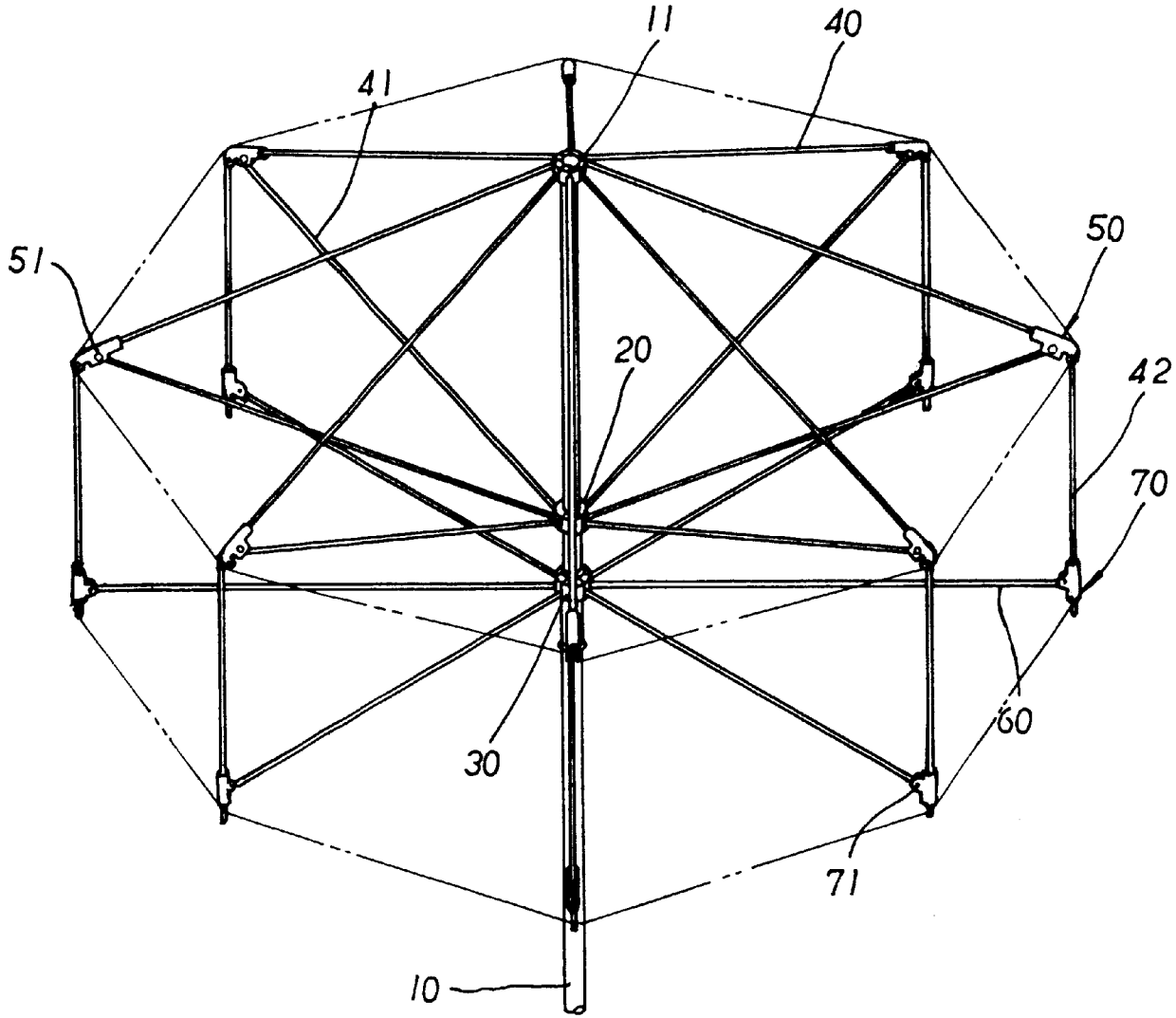
FIG. 6 is a diagram showing a canopy frame of the fourth embodiment of the present invention.

Referring to FIG. 6, a fourth embodiment of the present invention is illustrated The frame is comprised of a main shaft 10, an upper sliding notch 20, a lower sliding notch 30, eight positioning ribs 40, eight upper spreaders 41, eight upright ribs 42, eight upper angle-forming clamps 50, eight lower spreaders 60 and eight clamping pieces 70. There are two positioning holes (not shown) on the main shaft 10 for the fixing of the upper and lower sliding notch 20, 30 and at the top end of the main shaft 10 is disposed the fixed notch 1. The upper and lower sliding notch 20, 30 mounted consecutively on the main shaft 10 under the fixed notch 11. One end of each positioning rib 40 is connected to the fixed notch 11 and the other end is associated with an end hinge point 52 of an upper angle-forming clamp 50. One end of each upper spreader 41 is fixed to the upper sliding notch 20 and the other end is engaged with the middle hinge point 51 of an upper angle-forming clamp 50. One end hinge point 52 of each angle-forming clamp 50 is coupled to one end of each upright rib 42 to which is mounted a clamping piece 70 at the other end with a section of the upright rib 42 extended further downwardly. Each lower spreader 60 slightly shorter than each positioning rib 40 has one end connected to the lower sliding notch 30 and the other end coupled to the middle hinge point 71 of a clamping piece 70. A canopy is mounted to the frame to obtain a cone shaped umbrella.

Figure 7:
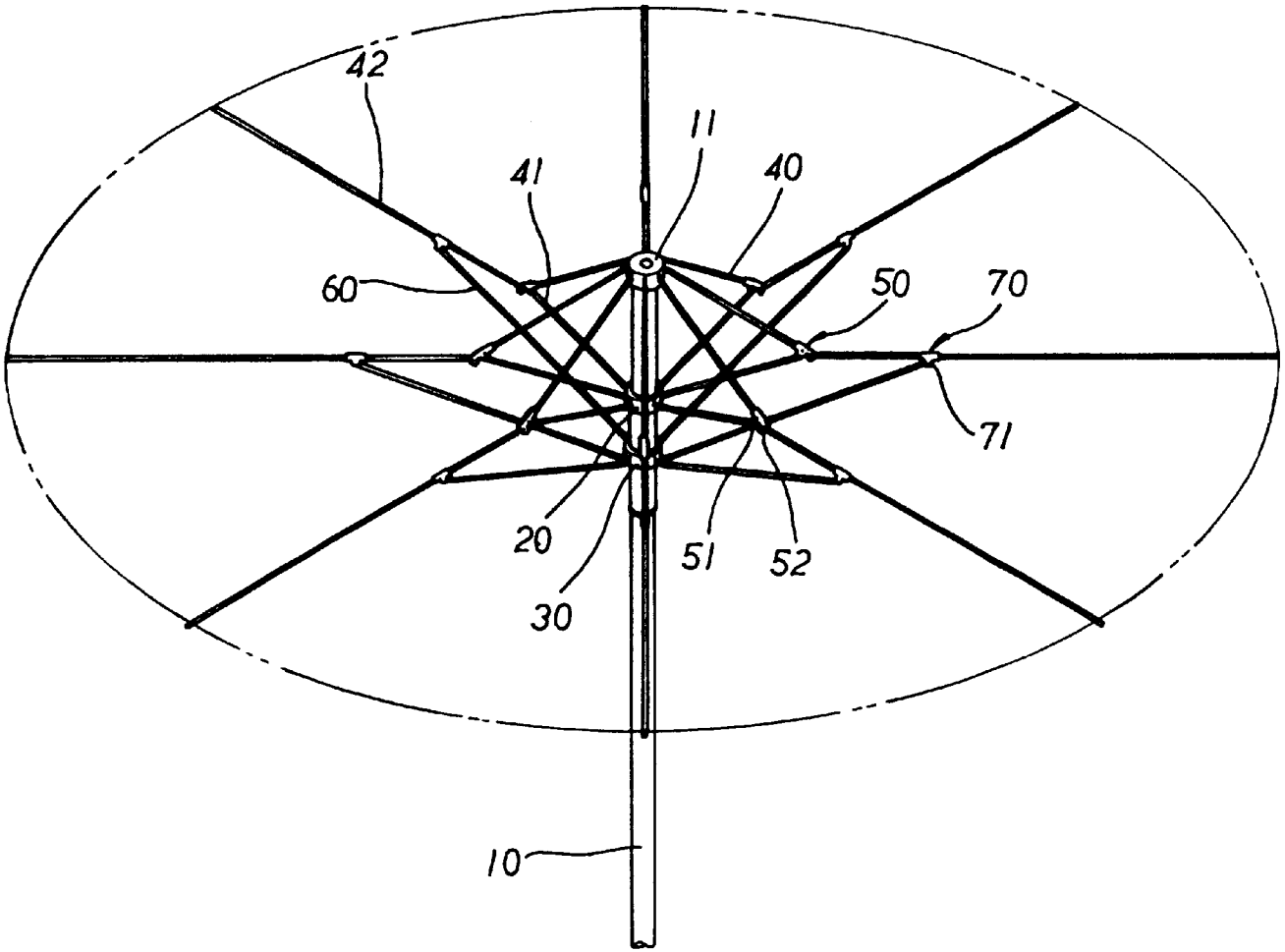
FIG. 7 is a diagram showing a canopy frame of the fifth embodiment of the present invention.

Referring to FIG. 7, a fifth embodiment of a common umbrella of the present invention is illustrated. The frame is comprised of a main shaft 10, an upper sliding notch 20, a lower sliding notch 30, eight positioning ribs 40, eight upper spreader 41, eight upright ribs 42, eight upper angle-forming clamps 50, eight lower spreaders 60 and eight clamping pieces 70. There are two positioning holes (not shown) on the main shaft 10 for the fixing of the upper and lower sliding notch 20, 30 and at the top end of the main shaft 10 is disposed the fixed notch 11. The upper and lower sliding notch 20, 30 mounted consecutively on the main shaft 10 under the fixed notch 11. One end of each positioning rib 40 is connected to the fixed notch 11 and the other end is associated with an end hinge point 52 of an upper angle-forming clamp 50. One end of each upper spreader 41 is fixed to the upper sliding notch 20 and the other end is engaged with the middle hinge point 51 of the upper angle-forming clamp 50. One remaining end hinge point 52 of each angleforming clamp 50 is coupled to one end of each upright rib 42 to which is mounted a clamping piece 70 at the other end with a section of the upright rib 42 extended further downwardly. Each lower spreader 60 has one end connected to the lower sliding notch 30 and the other end coupled to the middle hinge point 71 of a clamping piece 70. When extended, the lower spreaders 60 stretch the upright ribs 42 outwardly in a slant manner, just like a common umbrella. A canopy is mounted to the frame to obtain a general umbrella.

It can be apparently seen that the canopy frames of the present invention have the following advantages in practical use:

1. The main shaft 10 is provided with an upper sliding notch 20 and a lower sliding notch 30 and the positional variation of the upper angle-forming clamps 50, the lower angle-forming clamps 90 and the clamping pieces 70, and the length of each kind of ribs and spreaders, umbrellas of various kinds of shapes can be produced;

2. The upright ribs 42 and the folding ribs 81 can be downwardly extended in a vertical manner, permitting the periphery of an umbrella to be better protected from rain cast in slant directions.

What is claimed is:

1. An improved canopy frame for umbrella, comprising:

a main shaft (10), an upper slide notch (20), a lower sliding notch (30), an equal number of:

positioning ribs (40), upper spreaders (41), upright ribs (42), upper clamps (50), lower spreaders (60), and clamping pieces (70); and a fixed notch (11) at a top of the shaft 10, a pair of positioning holes for engaging said upper sliding notch (20) and said lower sliding notch (30), said fixed notch (11) being secured to a top end of said main shaft (10); said upper sliding notch (20) and said lower sliding notch (30) being consecutively mounted below said fixed notch (11);

wherein a first end of each of said positioning ribs (40) is rotatably engaged to said fixed notch (11) and a second end thereof is fixed to one of said upper angle-forming clamps (50); a first end of each said upper spreaders (41) is engaged to said upper sliding notch (20) and a second end thereof is rotatably engaged to a first hinge point of said one of said upper angle-forming clamps (50); a first end of each of said upright ribs (42), is rotatably engaged to a second hinge point of said one of said angle-forming clamps (50); one of said clamping pieces (70) is fixed to a midsection of each said upright ribs, each of which extends away from said one of said clamping pieces (70) toward a second end of each of said upright ribs (42); a first end of each of said lower spreaders (60) is rotatably engaged to said lower sliding notch (30) and a second end thereof rotatably engaged to a hinge point of said one of said clamping pieces (70); wherein when the upper notch (20) and the lower notch (30) are respectively engaged in said positioning holes, said lower spreaders stretch said upright ribs outwardly in a slant manner, and a canopy mounted to the frame forms an umbrella.

* * * * *